US006770857B2

(12) United States Patent
Hirota et al.

(10) Patent No.: US 6,770,857 B2
(45) Date of Patent: Aug. 3, 2004

(54) INDUCTION HEATING APPARATUS

(75) Inventors: Izuo Hirota, Toyonaka (JP); Atsushi Fujita, Mino (JP); Takahiro Miyauchi, Kobe (JP); Takeshi Kitaizumi, Toyonaka (JP); Yuji Fujii, Kobe (JP); Kouji Niiyama, Kobe (JP); Hideki Omori, Akashi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/373,745

(22) Filed: Feb. 27, 2003

(65) Prior Publication Data

US 2003/0164373 A1 Sep. 4, 2003

(30) Foreign Application Priority Data

Mar. 1, 2002 (JP) ..... 2002-056565

(51) Int. Cl.[7] ..... H05B 6/06

(52) U.S. Cl. ..... 219/626; 219/663; 219/665; 363/97

(58) Field of Search ..... 219/625, 626, 219/627, 661, 663, 665, 667, 666; 363/97, 98

(56) References Cited

U.S. PATENT DOCUMENTS 4,749,836 A * 6/1988 Matsuo et al. ..... 219/626
4,820,891 A * 4/1989 Tanaka et al. ..... 219/626
6,528,770 B1 * 3/2003 Akel et al. ..... 219/624

FOREIGN PATENT DOCUMENTS

JP 2001-246783 10/1989
JP 2001-160484 6/2001

* cited by examiner

*Primary Examiner*—Philip H. Leung
(74) *Attorney, Agent, or Firm*—Bacon & Thomas

(57) ABSTRACT

An induction heating apparatus can heat aluminum pot etc. with pot vibration noise being suppressed. During a turn-on time of second switching device 57, an energy is accumulated at choke coil 54, and at the same time a resonant current with a shorter period than the turn-on time of second switching device 57 or a driving time of first switching device 55 is generated at heating coil 59, so that during turn-off of second switching device 57, i.e., during on-time of first switching device 55, the energy accumulated at choke coil 54 is transferred to second smoothing capacitor 62. And then the output power is supplied from smoothing capacitor 62 to heating coil 59, thereby reducing the pot vibration noise, which is caused by pulsating current of input voltage.

14 Claims, 16 Drawing Sheets

HIGH OUTPUT POWER MODE

HIGH OUTPUT POWER MODE

INDUCTION HEATING APPARATUS

FIELD OF THE INVENTION

The present invention relates to an induction heating apparatus such as an induction heating cooking unit in which load of high conductivity and low permeability, e.g., an aluminum pot, can be heated efficiently; and a induction heating type water heater, humidifier, an iron or the like.

BACKGROUND OF THE INVENTION

As for a conventional induction heating apparatus, e.g., an induction heating cooking appliances, a technology capable of preventing both a pot vibration noise and reduction of power factor while heating an aluminum pot is disclosed, e.g., in Japanese Patent Laid-Open Publication No. 1989-246783, and a technology for reducing a switching loss and for heating an aluminum pot with high-frequency wave is disclosed, e.g., in Japanese Patent Laid-Open Publication No. 2001-160484.

FIG. 9 is a circuit included in Japanese Patent Laid-Open Publication No. 1989-246783 supra. In FIG. 9, bridge circuit 2, which rectifies AC(alternate current) power supply voltage of 100V to output DC(direct current) voltage, includes two thyristors 3, 4 and two diodes 5, 6. Thyristors 3, 4 control a conduction angle and, upon initiating the operation, reduce the DC voltage down to about 20V to set a low output power. And if load detector 24 detects an existence of a suitable load, output controller 26 controls the output power by varying the DC voltage.

Furthermore, input waveform shaper 23 drives transistor 10 to make an input current of a predetermined waveform based on signals outputted by input setting unit 25 and input current detector 22, thereby increasing the power factor. The enhancement of the power factor is achieved by accumulating energy in choke coil 8 when transistor 10 is turned on and then by transferring the energy to capacitor 11 via diode 9 when transistor 10 is turned off.

Also, in order to heat an aluminum pot, a frequency of a current passing through heating coil 18 is increased from 20 kHz to 50 kHz by varying the number of turns of heating coil 18 and the capacitance of resonant capacitor 19.

However, the prior art described above has many problems: that is, there is required a costly and complicated circuit structure capable of changing the number of turns of heating coil 18 in order to selectively heat both an aluminum pot and an iron pot; and there incurs a large switching loss in switching devices 15, 17 because the driving frequency thereof is required to be set at same 50 kHz in order to accommodate the resonant frequency of 50 kHz; and if a resonance point tracking method is adopted to decrease the switching loss, additive circuits, such as a control circuit therefor and a power supply voltage varying circuit for output power modification, are required.

Japanese Patent Laid-Open Publication No. 2001-160484 addresses the above-mentioned problems as in FIGS. 10 to 12.

In Japanese Patent Laid-Open Publication No. 2001-160484, a frequency of a resonant current passing through heating coil 18 and resonant capacitor 19 is set to be at least twice as high as that of driving signals fed to transistors 15, 17, in response to the signal from resonant current detector 30 for detecting a current passing through heating coil 18, thereby allowing for the heating of the aluminum pot by raising a frequency of the current supplied to heating coil 18, while suppressing the switching loss of the transistors 15, 17.

In an output control method for a low output power mode as shown in FIG. 11A, transistor 15 is turned off at a first instant when sign of collector current Ic1 thereof varies from positive value to zero and transistor 17 is turned off at a third instant when the sign of collector current Ic2 thereof varies from positive value to zero. Also, in a high output power mode as shown in FIG. 11B, transistor 15 is turned off at a second instant when the sign of collector current Ic1 thereof varies from positive value to zero and transistor 17 is also turned off at a second instant when the sign of collector current Ic2 thereof varies from positive value to zero.

Alternatively, in the low output power mode as shown in FIG. 12A, transistor 15 is turned off when time t1, which is shorter than a half period of the resonant current, elapses after transistor 15 is turned on and transistor 17 is turned off at a third instant when collector current Ic2 thereof decreases to zero from positive value. However, in the high output power mode as shown in FIG. 12B, transistor 15 is turned off at an instant when collector current Ic1 thereof drops to zero from positive value for the first time (turn-on time of transistor 15 corresponding to one half period of the resonant current) and transistor 17 is turned off at a third instant when the sign of collector current Ic2 thereof varies from positive value to zero.

The prior art induction heating apparatus of Japanese Patent Laid-Open Publication No. 2001-160484, however, suffers from certain drawbacks as follows. That is, a continuous output control cannot be achieved by the control method in FIGS. 11A, 11B, and a fine output control cannot be achieved by the control method in FIGS. 12A, 12B, because the variation of turn-on time produces too much variation of output power. Furthermore, because the envelope of current passing through heating coil 18 is not smoothed by the control methods of FIGS. 11A, 11B and FIGS. 12A, 12B, there occurs a pot vibration noise having a frequency of twice that of the commercial input power.

Japanese Patent Laid-Open Publication No. 1989-246783 addresses the problem of pot vibration noise generation, in which the output power is controlled by decreasing an input power fed to the inverter. However, even if this scheme is combined with the method disclosed in Japanese Patent Laid-Open Publication No. 2001-160484, suitable output control cannot be achieved because the resonant current is attenuated and thus cannot be maintained.

SUMMARY OF THE INVENTION

It is, therefore, an object of the present invention to provide an induction heating apparatus capable of heating an aluminum pot with a sufficiently large output power, in which the output power can be continuously adjusted with a fine controllability, while suppressing the generation of the pot vibration noise and switching loss in switching devices.

In accordance with the present invention, in case a load with a high conductivity and a low permeability is heated by a magnetic field generated by the heating coil, the resonant current passing through a switching device or a inverse-parallel diode (function as a reverse conducting device) resonates with a shorter period than a driving time of the switching device and further the DC voltage is boosted and smoothed by a boosting and smoothing circuit, and then provided for the inverter in order to maintain an amplitude of the resonant current to be higher than a certain value during the driving time, so that a switching loss of the switching device can be suppressed by lowering a driving frequency thereof, and at the same time the resonant current with higher frequency than the driving frequency thereof can be provided for the heating coil. Therefore, a load with a high conductivity and a low permeability, e.g., aluminum etc. can be heated with high output power.

Moreover, since the boosting and smoothing circuit for boosting and smoothing the input DC voltage fed to the inverter is provided to restrain the peak-to-peak value of the resonant current from attenuating to zero during the driving times of the switching device, in case of heating the load of high conductivity and low permeability, the output power can be stably controlled by varying the driving time of the switching device to be greater than one period of the resonant current and/or the burden (turn-on loss) of the switching device can be reduced.

In accordance with a first aspect of the present invention, there is provided an induction heating apparatus including:

an inverter having a switching device, a inverse-parallel diode (function as a reverse conducting device) connected to the switching device in parallel, a heating coil and a resonant capacitor, wherein the inverter generates a resonant current passing through the heating coil by turning on the switching devices;

a boosting and smoothing circuit; and a control circuit for controlling a turn-on time of the switching device, wherein in case a load with a high conductivity and a low permeability is heated by a magnetic field generated by the heating coil, the resonant current passing through the switching device or the inverse-parallel diode resonates with a shorter period than the turn-on time of the switching device and the DC voltage is boosted and smoothed by the boosting and smoothing circuit and then provided to the inverter in order to maintain an amplitude of the resonant current to be equal to or higher than a predetermined value during the turn-on time. Thus, a switching loss of the switching device can be suppressed by lowering a driving frequency thereof, and at the same time the resonant current with a higher frequency than the driving frequency can be provided for the heating coil. Therefore, a load with a high conductivity and a low permeability, e.g., aluminum etc. can be heated with a high output power.

Moreover, since the boosting and smoothing circuit for boosting and smoothing the input DC voltage fed to the inverter is provided to restrain the peak-to-peak value of the resonant current from attenuating to zero during the driving times of the switching device, in case of heating the load of high conductivity and low permeability, the output power can be stably controlled by varying the driving time of the switching device to be greater than one period of the resonant current and/or the burden (turn-on loss) of the switching device can be reduced.

In accordance with a second aspect of the present invention, there is provided an induction heating apparatus including:

an inverter including a resonant circuit having a first series connector containing a first switching device and a second switching device connected in series, a first inverse-parallel diode (function as a first reverse conducting device) connected to the first switching device in parallel, a second inverse-parallel diode (function as a second reverse conducting device) connected to the second switching device in parallel, and a second series connector, connected to the first and the second switching device in parallel, containing heating coil and a resonant capacitor, wherein the inverter resonates by turning on the first and the second switching devices;

a boosting and smoothing circuit; and a control circuit for exclusively turning on the first and the second switching device, wherein, in case a load with a high conductivity and a low permeability is heated by a magnetic field generated by the heating coil, the resonant current passing through the first switching device or the first inverse-parallel diode resonates with a shorter period than a turn-on time of the first switching device and the DC voltage is boosted and smoothed by the boosting and smoothing circuit, and then provided to the inverter in order to maintain an amplitude of the resonant current to be equal to or higher than a predetermined value during the turn-on time. And a burden of the switching devices can be reduced because two switching devices are used instead of only one, and at the same time, a fine and accurate output power control can be made according to the load by varying a ratio of driving times and/or a driving frequency of the switching devices.

Moreover, since the boosting and smoothing circuit for boosting and smoothing the input DC voltage fed to the inverter is provided to restrain the peak-to-peak value of the resonant current from attenuating to zero during the driving times of the switching devices, in case of heating the load of high conductivity and low permeability, the output power can be stably controlled by varying the driving times of the switching devices to be greater than one period of the resonant current and/or the burden (turn-on loss) of the switching devices can be reduced.

In accordance with a third aspect of the present invention, in particular, a boosting level of the DC voltage is determined by a turn-on time of at least one switching device included in the inverter. That is, by adjusting both the driving time and the boosting level, suitable output power control is made.

In accordance with a fourth aspect of the present invention, in particular, the boosting and smoothing circuit includes:

a smoothing capacitor connected in parallel to the first series connector including the first and the second switching device; and a choke coil connected to the second switching device in series, wherein an energy is accumulated in the choke coil when the second switching device is turned on, and then the energy is transferred to the smoothing capacitor via the first inverse-parallel diode by turning off the second switching device. Thus, envelope of a pulsating DC voltage fed to the choke coil is smoothed and boosted, meanwhile the energy is accumulated at the second smoothing capacitor. And this smoothed DC voltage serving as a power source can be supplied to the resonant circuit including the first and the second switching device. Therefore, the induction heating apparatus described in the second aspect of the present invention can be embodied with simple circuit structure safely.

In accordance with a fifth aspect of the present invention, in particular, in case of heating the load with the high conductivity and the low permeability by the magnetic field generated by the heating coil, the resonant current passing through the second switching device or the second inverse-parallel diode resonates with a shorter period than a turn-on time of the second switching device. Therefore, the frequency of the resonant current can be increased easily with having equal distribution of burden between the first and the second switching device, so that the driving time (or turn-on time) of the second switching device becomes longer than the period of the resonant current. Thus, the amount of energy accumulated at the choke coil becomes larger and the boosting level can be increased, so that the operation described in the second aspect of the present invention, i.e., the operation, a peak-to-peak value of the resonant current passing through the first switching device can be controlled not to come down to zero during the driving time of the first switching device, can be embodied easily.

In accordance with a sixth aspect of the present invention, in particular, high frequency components on accumulating the energy at the choke coil can be prevented from leaking into the power source by having an additional smoothing capacitor for giving an energy to the choke coil when the second switching device is turned on.

In accordance with a seventh aspect of the present invention, in particular, in the maximum output power mode, the control circuit outputs either a turn-off signal of the first switching device while the resonant current is passing therethrough after a start of the second period of the resonant current ensuing after turning on the first switching device, or a turn-off signal of the second switching device while the resonant current is passing therethrough after a start of the second period of the resonant current appearing after turning on the second switching device. Therefore, the turn-on loss of the second and the first switching device can be reduced in the maximum output power mode.

In accordance with a eighth aspect of the present invention, the control circuit outputs, in the maximum output power mode, either a turn-off signal of the first switching device during a period when the resonant current decreases from its peak value to zero after a start of the second period of the resonant current appearing after turning on the first switching device, or a turn-off signal of the second switching device during a period when the resonant current decreases from its peak value to zero after a start of the second period of the resonant current appearing after turning on the second switching device. Therefore, the first and the second switching device can be turned off when the resonant current is passing therethrough. Moreover, the first and the second switching device can be turned on when the resonant current is passing through the first and the second inverse-parallel diode in a forward direction, respectively.

In accordance with a ninth aspect of the present invention where a load of high conductivity and low permeability is heated by a magnetic field generated by the heating coil, the first resonant current passing through the first switching device and the first inverse-parallel diode or the second resonant current passing through the second switching device and the second inverse-parallel diode resonates with a period being approximately ⅔ of the driving time of the first or the second switching device, so that the switching devices are turned off when the resonant current reaches at second peak. Therefore, the amount of resonant current at the time of turning off either one of the switching devices becomes larger than that of the current at the time of turning off either one of the switching devices at the third peak of the resonant current.

Thus, after turning off the second switching device, a stable commutation is carried out easily for the current to pass through the first inverse-parallel diode in its forward direction, and the occurrence of the turn-on mode of the first switching device is prevented, resulting in a reduction of a switching loss and a high-frequency noise. Similarly, such also occurs in the second switching device and the second inverse-parallel diode, after turning off the first switching device. In case of a fourth or a fifth aspect of the present invention, which will be described hereinafter, the driving time of the second switching device becomes longer than that of the resonant current, so that the amount of energy accumulated at a choke coil increases. Thus, the boosting level also increases, so that above-mentioned operations can be carried out more efficiently.

In accordance with the tenth aspect of the present invention where the load of high conductivity and low permeability is heated by a magnetic field generated by the heating coil, the ratio of driving times of the first and the second switching device is set at 1 approximately, and the resonant current passing through the first switching device or the first inverse-parallel diode resonates with a period being approximately ⅔ of the driving time of the first switching device. Therefore, the first and the second switching device are turned on when the resonant current is passing through the first and the second inverse-parallel diode in their forward direction and at the same time, the first and the second switching device are turned off when the resonant current is passing through the first and the second switching device in their forward direction.

Moreover, since the resonant current resonates with the period of approximately ⅔ of the driving time of the first and the second switching device, switching devices can be turned off around the second peak of the resonant current. Therefore, switching devices can be turned off when the resonant current is attenuated by a small amount. Thus, a commutation is carried out stably, for the resonant current to pass through the second and the first inverse-parallel diode in their forward direction after turning off the first and the second switching device, so that the turn-on mode of the switching devices can be restrained from occurring and a switching loss and a high-frequency noise thereof can be avoided. Further, the resonant current with a high frequency of 3 times as high as the driving frequency of the switching devices can be provided for heating coil.

In accordance with the eleventh aspect of the present invention, in starting a heating operation, an output power is increased by varying the ratio of driving times of the first and the second switching device and then by varying the driving frequency, thus resulting in easy detection of the load. That is to say, an output power transmitted to either a load of high conductivity and low permeability like aluminum etc., or an iron based load can be varied steadily in the low output power mode by varying the ratio of driving times, and thus the load can be detected accurately in the low output power mode.

Moreover, after reaching a predetermined ratio of driving times, driving time, or output power, the ratio of driving times is set at a constant value in order to drive and turn off the switching devices within a specific range of phase in the case of the load of high conductivity and low permeability. While maintaining the ratio of driving times at constant value, a turn-off phase and the driving frequency are changed, so that an output power can be adjusted without significantly increasing the loss of switching devices.

In accordance with a twelfth aspect of the present invention, upon initiating the heating operation, the driving time of the first switching device is set to be shorter than the resonant period of the resonant current and then an output power is increased by changing the ratio of driving times of the first and the second switching device until a certain driving time or a certain ratio of driving times is reached. During that time, it is accurately and safely detected whether or not the load is of high conductivity and low permeability. In case the load is detected to be of high conductivity and low permeability, the driving time of first switching device is dispersedly increased to lower the output power, and then the output power is stably increased from the low level to a desired level by steadily increasing the length of the driving time.

In accordance with a thirteenth aspect of the present invention, in case of heating iron-based load or load of a non-magnetic by the magnetic field generated by the heating coil, the resonant current resonates with a longer period than the driving time of the first and the second switching device. And in case the load of iron-based material or non-magnetic stainless steel is heated with a maximum output power, a resonance compensation capacitor is connected to the resonant capacitor in parallel, resulting in larger capacitance than that of the case when a load is of high conductivity and low permeability, in order to turn off the first and the second switching device at the time when a current passes through the first and the second switching device in a forward direction. Thus in case of the load of iron-based material or non-magnetic stainless steel, the resonant period becomes longer and at the same time the resonant current is increased. Further, since DC voltage Vdc is boosted by the choke coil, an amplitude of the resonant current becomes larger. Therefore, the maximum output power can be made to be larger than that of the prior art, in case the turn-on switching loss is suppressed by setting up the maximum output power within the range which enables the switching devices to be turned off at the time a current is passing through the switching devices in their forward direction.

In the prior art induction cooking apparatus, the selective heating of an aluminum based pot and an iron based pot using a same inverter was made by changing the number of turns of the heating coil in order to change the intensity of magnetic field (ampere-turn) transmitted to the load. In accordance with the present invention, however, the effect of converting the number of turns is achieved by the boosting operation of the second switching device and the choke coil, and the resonant capacitance is adjusted through the use of the resonance compensation capacitor, so that load of wide range of materials can be heated by using the same heating coil.

In accordance with a fourteenth aspect of the present invention, the operation of the embodiment of the present invention is started with no connection of the resonance compensation capacitor to the resonant capacitor, i.e., with lower capacity, and an output is increased by degrees, meanwhile load is detected to be whether it is of iron or of high conductivity and low permeability. If load is found to be iron, the operation thereof is stopped and the resonance compensation capacitor is connected to the resonant capacitor in parallel by turning on a relay, i.e., higher capacity and the driving frequency is set to be low frequency again.

However, if load is detected to be of high conductivity and low permeability, the output is increased until certain ratio of driving times or certain output power is reached, and then the ratio of driving times is fixed but the driving frequency of switching device is varied, to thereby reach a suitable output power. Therefore, according to the result of discrimination between a load of high conductivity and low permeability and a load of iron based, with low output power, suitable resonant capacitor and suitable driving method are chosen, thereby achieving a suitable output power.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS (Embodiment 1)

The first embodiment of the present invention will now be described by referring to drawings.

Figure 1:
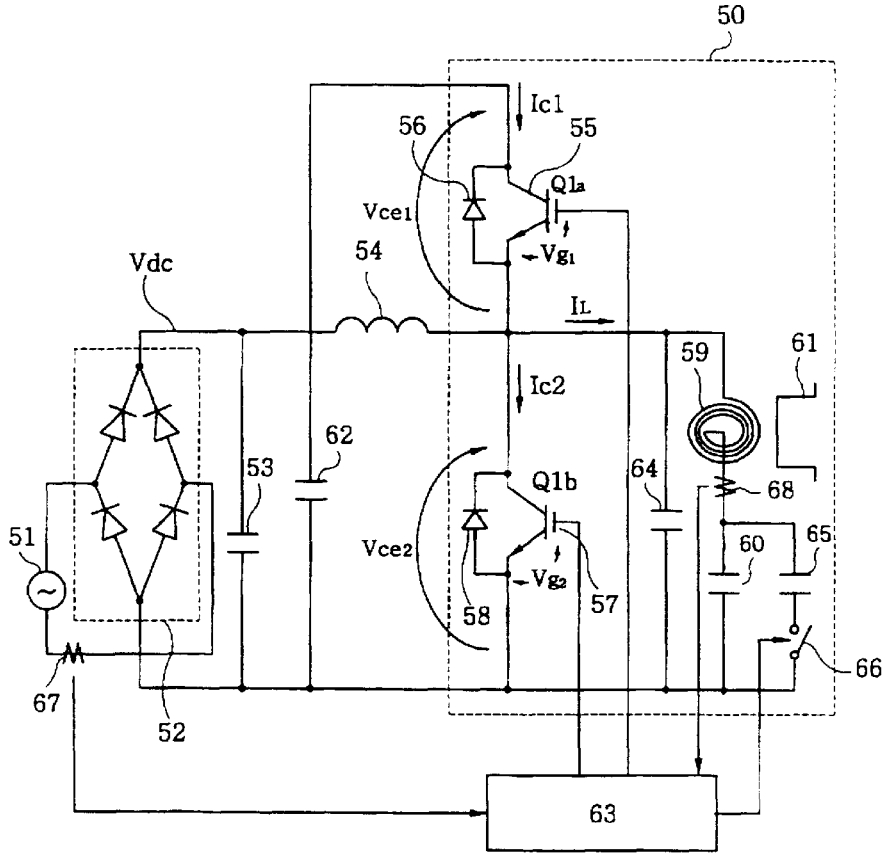
FIG. 1 shows a circuit of an induction heating apparatus in accordance with a first embodiment of the present invention.

FIG. 1 shows a circuit diagram of an induction heating apparatus of the first embodiment of the present invention. Power source 51 is a commercial AC power source of low-frequency 200 V and is coupled to an input port of bridge circuit 52. First smoothing capacitor 53 and a series connector including choke coil 54 and second switching device 57, are connected between output ports of bridge circuit 52. Heating coil 59 is arranged to face aluminum pot 61 to be heated. Herein, pot 61 can be of, not only Al, Cu, but also Al, Cu-based material.

Reference number 50 indicates inverter. A port of a lower electric potential of second smoothing capacitor 62 and an emitter of second switching device 57 are connected to a cathode port of bridge circuit 52 and a port of a higher electric potential of second smoothing capacitor 62 is connected to a collector (a port of a higher electric potential) of first switching device 55 (IGBT: insulated gate bipolar transistor). A port of a lower electric potential of first switching device (IGBT) 55 is connected to a junction point of choke coil 54 and a port of a higher electric potential of second switching device (IGBT) 57. A series connector including heating coil 59 and resonant capacitor 60 is connected to second switching device 57 in parallel.

First diode 56 (first inverse-parallel diode which serves as a first reverse conducting device) is connected to first switching device 55 in an inverse-parallel manner (a cathode of first diode 56 is connected to a collector of first switching device 55), and second diode 58 (second inverse-parallel diode which serves as a second reverse conducting device) is connected to second switching device 57 in the inverse-parallel manner. Snubber capacitor 64 is connected to second switching device 57 in parallel. A series connector including resonance compensation capacitor 65 and relay 66 is connected to resonance capacitor 60 in parallel. A detecting signal from input current detector 67 for detecting an input current supplied by power source 51 and another detecting signal from resonant current detector 68 for detecting a current passing through heating coil 59 are fed to control circuit 63, and control circuit 63 outputs driving signals to the gates of first switching device 55 and second switching device 57 and a driving coil (not shown) of relay 66.

The operation of the induction heating apparatus, structured as described above, will now be expounded below. The power of power source 51 undergoes a full wave rectification when it passes through bridge circuit 52, and then the full wave rectified power is fed to first smoothing capacitor 53 connected to the output ports of bridge circuit 52. First smoothing capacitor 53 serves as a power source for providing inverter 50 with high-frequency current.

Figure 2A:
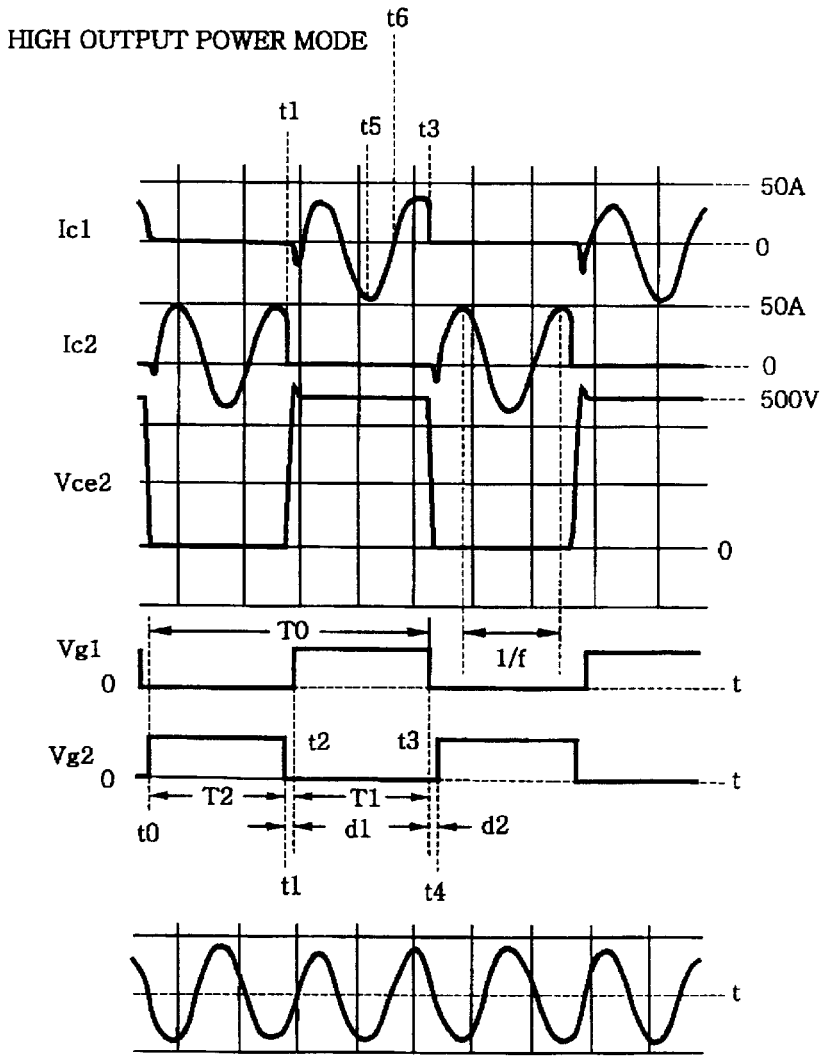
FIG. 2 describes waveforms of a current or a voltage of each portion in the induction heating apparatus in accordance with the first embodiment of the present invention.
Figure 2B:
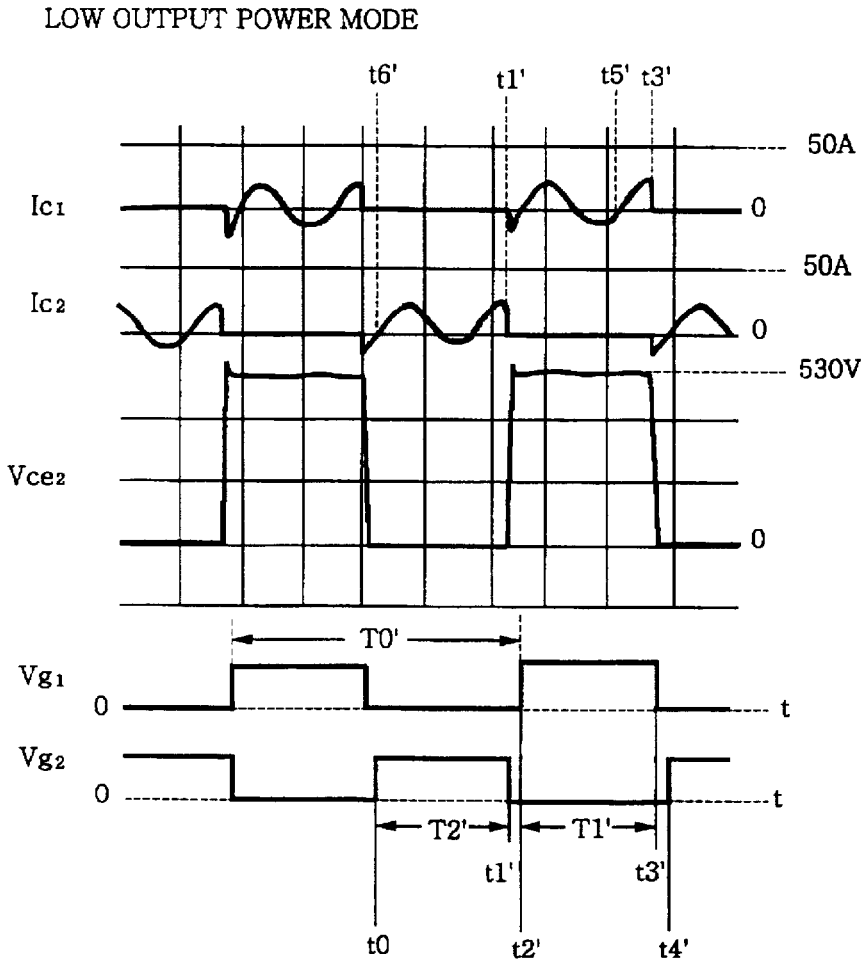

FIGS. 2A and 2B represent waveforms of current and voltage of various portions in the circuit of FIG. 1, and in case of FIG. 2A, an output power is, e.g., 2 kW, which is larger than that of FIG. 2B. Referring to FIG. 2A, there are illustrated a current waveform Ic1 passing through first switching device 55 and first diode 56; a current waveform Ic2 passing through second switching device 57 and second diode 58; a waveform of potential difference Vce2 between the collector and the emitter of second switching device 57; a driving voltage waveform Vg1 fed to the gate of first switching device 55; a driving voltage waveform Vg2 fed to the gate of second switching device 57; and a current waveform IL passing through heating coil 59. As shown in FIGS. 2A, 2B, first and second switching device 55, 57 are exclusively turned on.

In case the output power is 2 kW (FIG. 2A), control circuit 63 outputs on-signal from a point of time t0 to a point of time t1: i.e., during a driving time (or a turn-on time) T2 as shown in a plot of Vg2 in FIG. 2A (approximately 24 $\mu$s) to the gate of second switching device 57. During the driving time T2, a first closed loop circuit including second switching device 57, second diode 58, heating coil 59 and resonant capacitor 60 resonates, wherein the number of turns (40T) of heating coil 59, capacitance (0.04 $\mu$F) of resonant capacitor 60 and the driving time T2 are established to render the resonant period (1/f) of an aluminum pot to be approximately ⅔ of the driving time T2. Choke coil 54 stores an electrostatic energy of smoothing capacitor 53 in a form of a magnetic energy during the driving time T2 of second switching device 57.

Next, second switching device 57 is turned off at a time t1 when the resonant current passing therethrough decreases to zero after the second peak value of the resonant current, i.e., when the collector current of second switching device 57 flows in a forward direction.

Then, since second switching device 57 is turned off, an electric potential of a port of choke coil 54, the port being connected to the collector of switching device 57, is boosted, and if the electric potential of the port of choke coil 54 exceeds that of second smoothing capacitor 62, the magnetic energy stored in choke coil 54 is released by charging second smoothing capacitor 62 via first diode 56. The voltage of second smoothing capacitor 62 is boosted (to 500 V in the embodiment of the present invention) to be higher than the peak DC output voltage (e.g., 283 V) of bridge circuit 52. The level of boost depends on on-time of second switching device 57, so that, as the on-time is longer, the voltage of second smoothing capacitor 62 tends to be higher.

As such, a voltage level of second smoothing capacitor 62 is boosted, which serves as a DC power supply when a second closed loop circuit including second smoothing capacitor 62, first switching device 55 or first diode 56, heating coil 59 and resonant capacitor 60 resonates. Therefore, a peak-to-peak value of a resonant current passing through first switching device 55 as shown in a plot of Ic1 in FIG. 2A and that of another resonant current passing through second switching device 57 as shown in a plot of Ic2 in FIG. 2A do not decrease to zero, enabling to heat the aluminum pot inductively with a high output power and control output power by continuously increase and decrease the power level.

And as shown in a plot of Vg1 and Vg2 in FIG. 2A, control circuit 63 outputs another driving signal to the gate of first switching device 55 at time t2, i.e., after some pause period d1 from time t1, for preventing both switching devices from turning on simultaneously. The resonant current begins to pass through the second closed loop circuit. In this case, the driving time T2 is set up as nearly same as T1, so that the resonant current flows with the period of approximately ⅔ of the driving time T1, as in the case second switching device 57 is turned on.

Therefore, current IL passing through heating coil 59 has a waveform as shown in FIG. 2A so that a driving period (which is the summation of T1, T2 and pause d1) is approximately three times the period of the resonant current, where both first and second switching device 55, 57 being considered. Thus, if the driving frequency of first and second switching device 55, 57 is approximately 20 kHz, the frequency of the resonant current passing through heating coil 59 is approximately 60 kHz.

Figure 3:
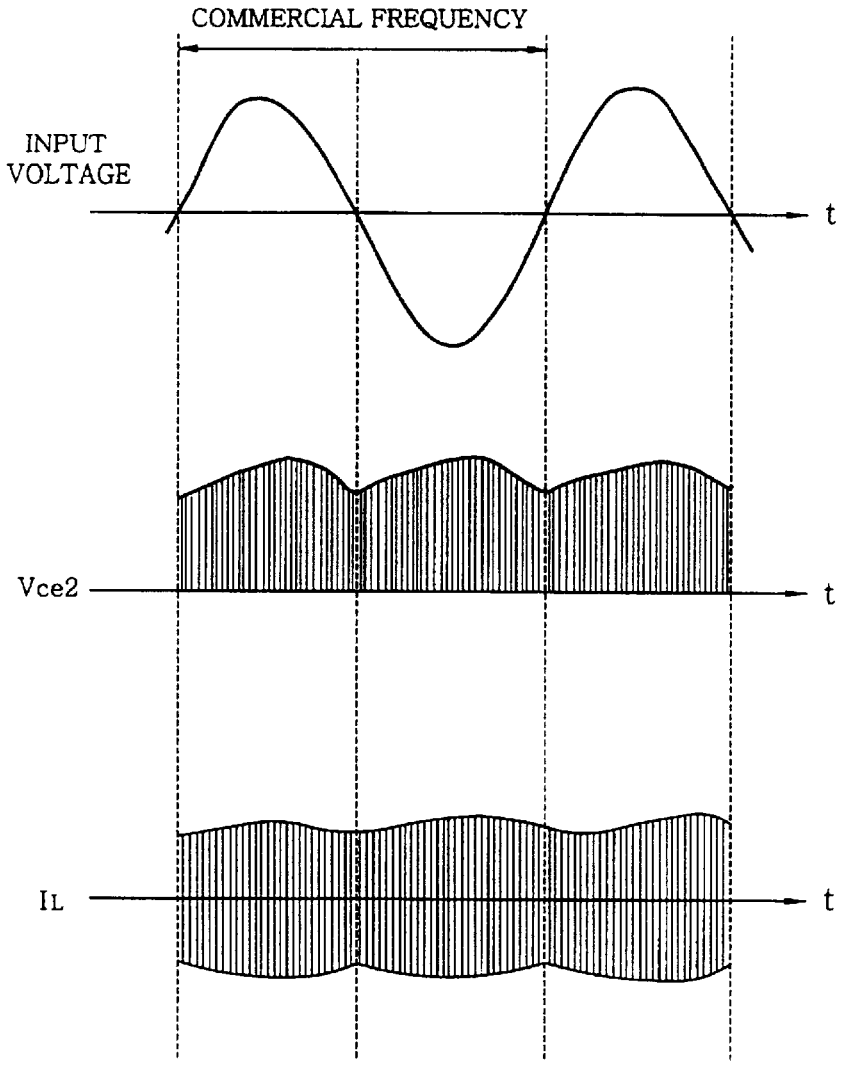
FIG. 3 illustrates other waveforms of a current or a voltage of each portion in the induction heating apparatus in accordance with the first embodiment of the present invention.
Figure 13:
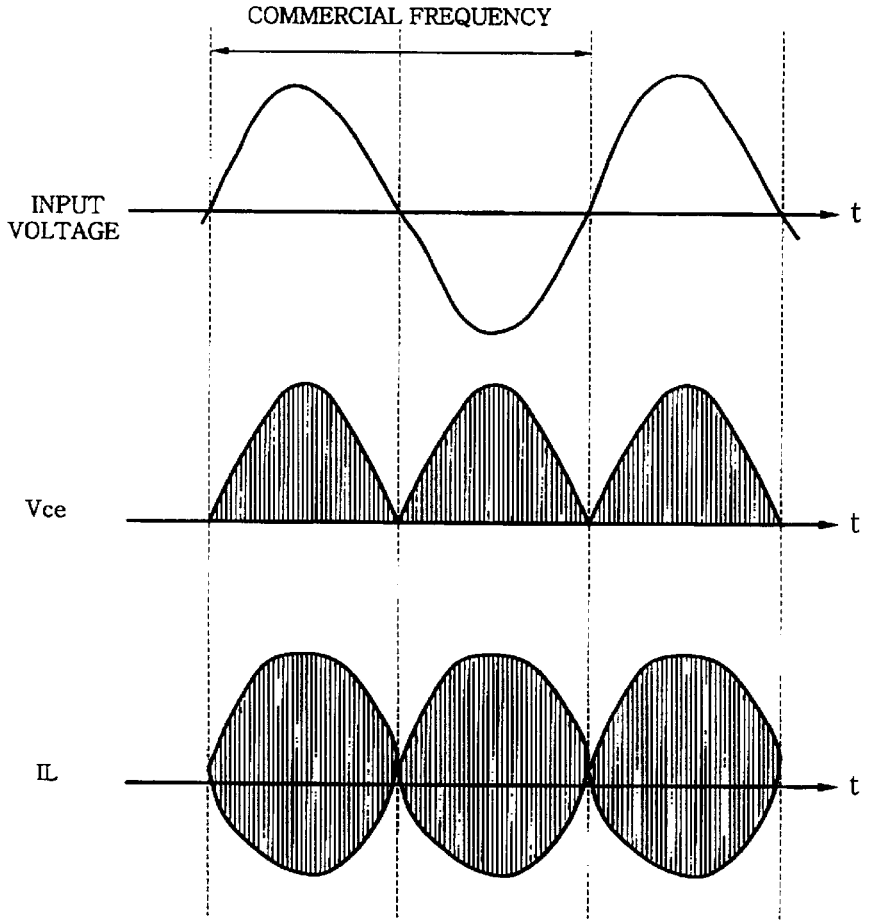
FIG. 13 (PRIOR ART)
FIG. 13 describes still another waveforms of a current or a voltage of each portion in the conventional induction heating apparatus of FIG. 10.

FIG. 3 shows an input voltage waveform of commercial power source 51, a voltage waveform Vce2 across the series connector including heating coil 59 and resonant capacitor 60, and current waveform IL passing through heating coil 59. The output voltage of bridge circuit 52 has a pulsating current waveform acquired by full wave rectification of the voltage of commercial power source 51 as shown in FIG. 3, but since an envelop of a current passing through heating coil 59 is smoothed by second smoothing capacitor 62 as shown in a plot of IL in (FIG. 3, the pot vibration noise, which is generated at the frequency which is two times the frequency of the commercial power supply, e.g., by current IL of a heating coil of the prior art as shown in a plot of IL in FIG. 13, is prevented.

The waveforms in FIG. 2B are acquired in the low output power mode, e.g., 450 W. The waveforms Ic1, Ic2, Vce2, Vg1 and Vg2 in FIG. 2B correspond to those of FIG. 2A, respectively. Herein, a control of the output power is executed by establishing a driving time T1' of first switching device 55 and a driving time T2' of second switching device 57 to be shorter than the driving time T1, T2 of first and second switching device 55, 57, respectively.

In FIG. 2A, in case second switching device 57 is turned on at a point of time t5 when a current passing through first diode 56 goes to maximum, the output power goes to minimum or nearly minimum. However, the maximum output power is obtained if first switching device 55 is turned off and second switching device 57 is turned on simultaneously at the time when the current passing through first switching device 55 goes to zero (not shown) again by resonance after the current begins to increase from zero to positive value for the second time (at a point of time t6) (resonance point power control).

By the above-mentioned principle, in case of low output power mode, e.g., the output power is set at 450 W, the driving time T1' is determined to be shorter than that of maximum output power, e.g., 2 kW, but first switching device 55 is turned off at a point of time t3' when a current is passing through first switching device 55 in a forward direction as shown in FIG. 2B. Thus, with turn-off of first switching device 55 in both cases of the maximum output power mode and lower output power mode, snubber capacitor 64 and heating coil 59 resonates with the aid of the accumulated energy at heating coil 59, the electric potential of the collector of first switching device 55 is reduced, and the voltage difference between the emitter and collector thereof is increased slowly, resulting in reduction of a switching loss.

As a result, a turn-off loss of first switching device 55 can be reduced. Further, since the voltage level applied in a forward direction can be pulled down to zero or a small value when second switching device 57 is turned on, the turn-on loss or noise occurrence can be prevented.

Next, in initiating operation, control circuit 63 controls relay 66 to be turned off and drives first and second switching device 55, 57 alternatively, at the constant frequency (approximately 21 kHz). The driving time of first switching device 55 is shorter than the resonant period of the resonant current, and a ratio of driving times and the output power are set to be minimum. And then, the ratio of driving times is slowly increased. Meanwhile control circuit 63 detects a material of load pot 61 by referring to detection outputs of input current detector 67 and resonant current detector 68. If control circuit 63 finds the material to be iron-based, it stops heating and controls relay 66 to be turned on, and restarts heating again with a low output power. At this time, control circuit 63 sets the ratio of driving times of first and second switching device 55, 57 and the output power to be minimum, and then steadily increases the ratio of driving times until a desired output power is obtained, while maintaining the constant frequency (approximately 21 kHz).

However, in case the material is not found to be iron-based and when a predetermined ratio of driving times is reached, the operation is carried out in a mode where the period of the resonant current becomes shorter than the driving time of first switching device 55, as shown in FIG. 2B. Herein, the driving time is set up such that the output power is low.

Figure 4:
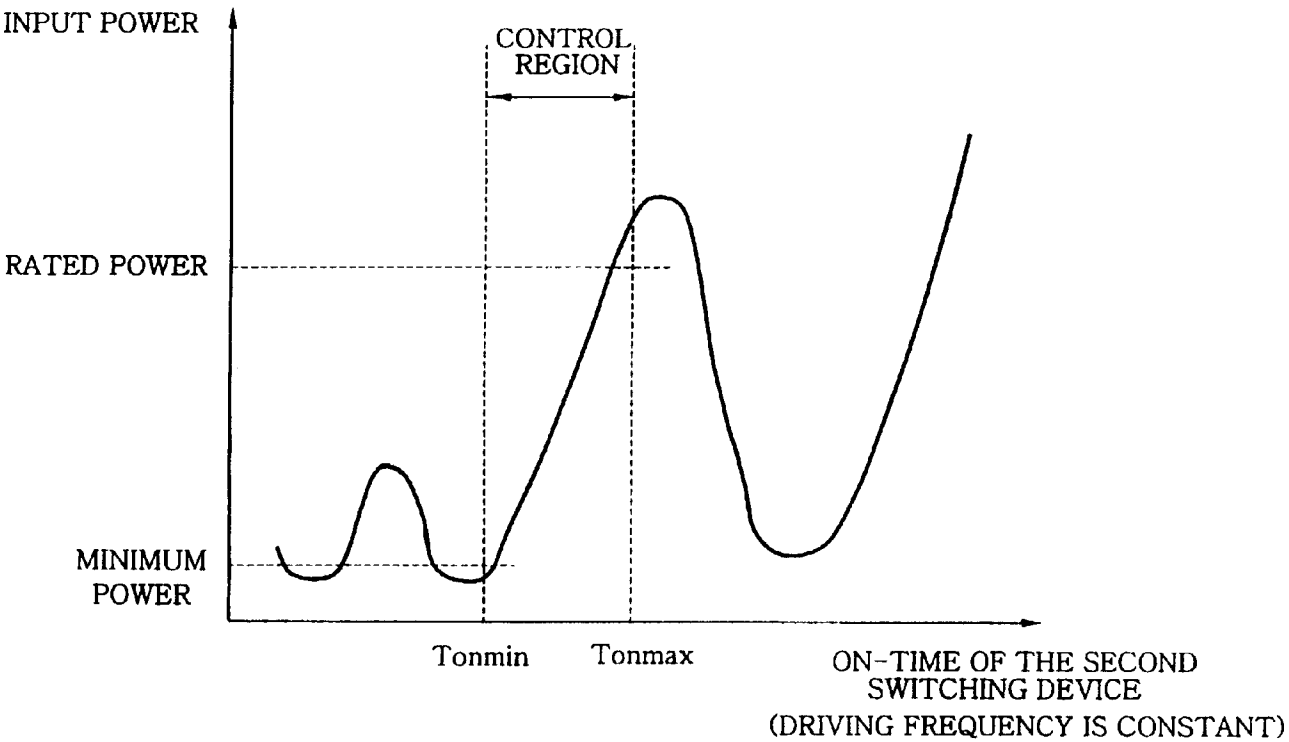
FIG. 4 offers a control characteristic of an input power in the induction heating apparatus in accordance with the first embodiment of the present invention.

FIG. 4 represents a plot of an input power versus on-time of second switching device 57 when the driving frequency of first and second switching device 55, 57 is constant. In the embodiment of the present invention as shown in FIG. 4, an output of approximately 2 kW can be reached around a point of ½ period, and when the driving time of second switching device 57 is made to be shorter from the point in the plot, the output can be decreased linearly. Therefore, a stable control is achieved by setting up a lower limit (Tonmin) and an upper limit (Tonmax) of the driving time or the ratio of driving times.

As mentioned above, in case the load of high conductivity and low permeability, e.g., aluminum, copper, or the like is heated by a magnetic field generated by heating coil 59 in accordance with the embodiment of the present invention, the resonant current by heating coil 59 and resonant capacitor 60 passing through first switching device 55 and first diode 56 resonates with a shorter period than driving time T1, T2 of both switching devices, so that a current with a higher frequency than the driving frequency of first switching device 55 (1.5 times higher in this embodiment) can be provided for heating coil 59. Furthermore, since the voltage of smoothing capacitor 62, which serves as a high frequency power source, is boosted and smoothed by choke coil 54 and second smoothing capacitor 62, respectively, an amplitude of the resonant current can be boosted in each driving period T, T', thus the boosted amplitude of the resonant current can be maintained even after entering the second period of the resonant current, and therefore a large output power range can be obtained by varying a driving stopping timing of each switching device after entering the second period of the resonant current.

Also, choke coil 54 as a booster varies a level of boosting according to the driving time of second switching device 57. For instance, as the on-time of second switching device 57 becomes longer, the voltage of smoothing capacitor 62 goes higher due to the boosting operation of the choke coil 54, and can be used in output power control.

Moreover, since the boosting operation is executed when the energy, accumulated at choke coil 54 by the turn-on of second switching device 57, is transferred to second smoothing capacitor 62 via first diode 56, the input of the pulsating current can be changed into the power source of smoothed high voltage by a simple circuit structure. Further, since heating coil 59 is provided with the current of high frequency, an envelope thereof being smoothed and obtained from the power source of smoothed high voltage, the generation of pot vibration noise can be suppressed.

Also, in case a load of high conductivity and low permeability like aluminum, copper, etc. is heated by a magnetic field generated by heating coil 59, the resonant current passing through second switching device 57 and second diode 58 resonates with a shorter period than driving time T2 of second switching device 57. Therefore, when considering the total resonant current (sum of Ic1 and Ic2), it can be seen that a wavenumber of the total resonant current during the driving time of the first and the second switching device comes to increase.

Moreover, high frequency components on accumulating the energy at choke coil 54 can be prevented from leaking into power source 51 by having first smoothing capacitor 53 for giving energy to choke coil 54 when second switching device 57 is turned on.

Furthermore, in the maximum output power mode, control circuit 63 outputs either a turn-off signal of first switching device 55 while the resonant current is passing therethrough after a start of the second period of the resonant current ensuing after turning on first switching device 55, or a turn-off signal of second switching device 57 while the resonant current is passing therethrough after a start of the second period of the resonant current appearing after turning on second switching device 57. Therefore, the turn-on loss of second switching device 57 and first switching device 55 can be reduced.

And control circuit 63 outputs, in the maximum output power mode, either a turn-off signal of first switching device 55 during a period when the resonant current decreases from its peak value to zero after a start of the second period of the resonant current appearing after turning on first switching device 55, or a turn-off signal of second switching device 57 during a period when the resonant current decreases from its peak value to zero after a start of the second period of the resonant current appearing after turning on second switching device 57. Therefore, a turn-on loss of second switching device 57 or first switching device 55 can be restrained. Further, in case of reducing driving time thereof, the output power can be dropped, and the turn-on loss can also be restrained because each switching device is not easily driven into a turn-on mode even in the low output power mode.

Moreover, in case the ratio of driving times of first and second switching device 55, 57 is set at 1 approximately, and at the same time a load of high conductivity and low permeability is heated by the magnetic field generated at heating coil 59, the resonant current passing through first switching device 55 and first diode 56 resonates with a period of approximately ⅔ of the driving time of first switching device 55. Consequently, three wave numbers of the resonant current can be allotted during one cycle of the driving times of both first and second switching device 55, 57. Therefore, the current with a high frequency component of approximately three times the driving frequency can be provided for heating coil 59. And at the same time, a stable output power control can be made because a start of the driving of first switching device 55 can be made when a current is passing through first diode 56, and a stop of the driving thereof is made when a current is passing through first switching device 55 in forward direction, and also same can be applied to second switching device 57 and second diode 58.

Also, in starting operation, an output power is increased by varying the ratio of driving times of first and second switching device 55, 57 and then by varying the driving frequency, thus resulting in easy detection of the load. That is to say, an output power transmitted to either a load of high conductivity and low permeability like aluminum etc., or an iron based load can be varied steadily in the low output power mode by varying the ratio of driving times, and thus the load can be detected accurately in the low output power mode.

Moreover, after reaching a predetermined ratio of driving times, driving time, or output power, the ratio of driving times is set at a constant value in order to drive and turn off switching devices within a specific range of phase in the case of the load of high conductivity and low permeability. While maintaining the ratio of driving times at constant value, a turn-off phase and the driving frequency are changed, so that an output power can be adjusted without significantly increasing the loss of switching devices.

Furthermore, upon initiating the operation, the driving time of the first switching device 55 is set to be shorter than the resonant period of the resonant current and then an output power is increased by changing the ratio of driving times of the first and the second switching device 55, 57 until a certain driving time or a certain ratio of driving times is reached. During that time, it is accurately and safely detected whether or not the load is of high conductivity and low permeability. In case the load is detected to be of high conductivity and low permeability, the driving time of first switching device 55 is dispersedly increased to lower the output power, and then the output power is stably increased from the low level to a desired level by steadily increasing the length of the driving time.

Also, in case of heating iron-based load or load of a non-magnetic by the magnetic field generated by heating coil 59, the resonant current resonates with a longer period than driving time of first and second switching device 55, 57. And in case the load of iron-based material or non-magnetic stainless steel is heated with a maximum output power, resonance compensation capacitor 65 is connected to resonant capacitor 60 in parallel, resulting in larger capacitance than that of the case when a load is of high conductivity and low permeability, in order to turn off first and second switching device 55, 57 at the time when a current passes through first and second switching device 55, 57 in a forward direction. Thus in case of the load of iron-based material or non-magnetic stainless steel, the resonant period becomes longer and at the same time the resonant current is increased. Further, since DC voltage Vdc is boosted by choke coil 54, an amplitude of the resonant current becomes larger. Therefore, the maximum output power can be made to be larger than that of the prior art, in case the turn-on switching loss is suppressed by setting up the maximum output power within the range which enables the switching devices to be turned off at the time a current is passing through the switching devices in their forward direction.

In the prior art induction cooking apparatus, the selective heating of an aluminum based pot and an iron based pot using a same inverter was made by changing the number of turns of heating coil 59 and the resonant capacitor simultaneously in order to change the resonant frequency and the intensity of magnetic field (ampere-turn) transmitted to load 61. In accordance with the present invention, however, the effect of converting the number of turns is achieved by the boosting operation of second switching device 57 and choke coil 54, and the resonant capacitance is adjusted through the use of resonance compensation capacitor 65, so that load of wide range of materials can be heated by using a same heating coil 59.

Moreover, the operation of the embodiment of the present invention is started without connecting resonance compensation capacitor 65 to resonant capacitor 60, i.e., with lower capacitance, and an output is steadily increased; and meanwhile it is detected whether the load is of an iron-based material or of high conductivity and low permeability. If the load is found to be iron-based, the operation thereof is stopped and resonance compensation capacitor 65 is connected to resonant capacitor 60 in parallel by turning on relay 66, to attain higher capacitance. And then the operation is resumed with a low driving frequency, resulting in the longer resonant period and the increased current. And at the same time since DC voltage Vdc is boosted by choke coil 54 and second smoothing capacitor 62, the resonant current becomes larger. Therefore, the maximum output power can be made to be larger than that of the prior art, in case the turn-on switching loss is suppressed by setting up the maximum output power within the range which enables the switching devices to be turned off at the time a current is passing through the switching devices in their forward direction.

However, if the load is detected to be of high conductivity and low permeability, the output continues to increase until a certain ratio of driving times or a certain output power is reached, and then the ratio of driving times is fixed but the driving time is varied to increase the output power up to a certain value. Therefore, both cases can execute the so-called a soft start operation, i.e., first detecting the material of the load with the low output power and then increasing the output power up to a certain output value or a limit value in a stable manner.

Moreover, in FIG. 1, the ratio of capacitances of first smoothing capacitor 53 and second smoothing capacitor 62 is to be adaptively determined case by case. For example, if the capacitance of the former is set to be 1000 μF and that of the latter is 15 μF, a smoothing level of the envelop of the current passing through heating coil 59 is enhanced. In such a case, it may be advantageous to insert a choke coil at the input power line of first smoothing capacitor 53. On the contrary, if the capacitance of the former is set at 10 μF, and that of latter is at 100 μF, degradation of the power factor can be restrained, but in this case, costly second smoothing capacitor 62 may be needed because it is required to have a large breakdown voltage.

In FIG. 1, it should be noted that a port of second smoothing capacitor 62 with low electric potential can be connected to the anode of bridge circuit 52 and snubber capacitor 64 can be connected to first switching device 55 in parallel to have the same effect.

Furthermore, a port of resonant capacitor 60 with low electric potential can be connected to the collector (high electric potential) of first switching device 55; and also by dividing the capacitance thereof into two, the divided capacitors can be connected to the collector of first switching device 55 and the emitter (low electric potential) of second switching device 57, respectively to have the same effect. And a resonant circuit which can be connected to first or second switching device 55, 57 is not limited to the embodiment of the present invention. It can be a suitably modified version of the one disclosed in the preferred embodiment of the invention.

Though an induction heating cooking appliances has been described in the preferred embodiment in the present invention, the present invention can be equally applied to other types of induction heating apparatus such as a water heater and an iron etc., for heating a load of high conductivity and low permeability like an aluminum pot.

(Embodiment 2)

Figure 5:
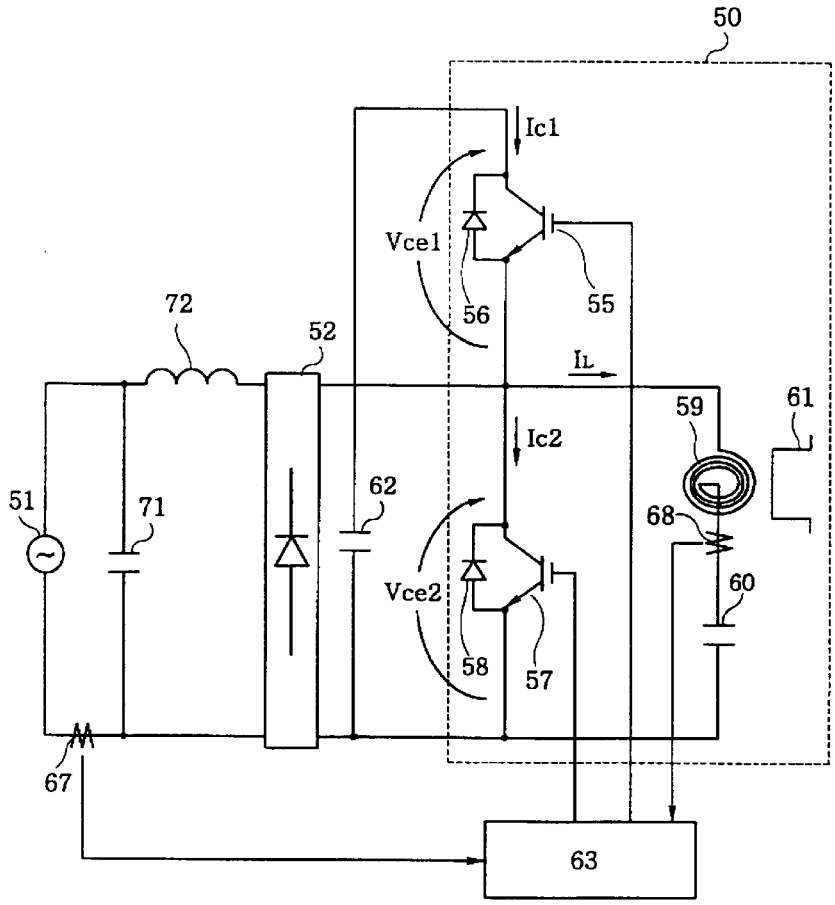
FIG. 5 provides a circuit of an induction heating apparatus in accordance with a second embodiment of the present invention.

An induction heating apparatus in accordance with a second preferred embodiment of the present invention will now be described by referring to the drawings. FIG. 5 shows a circuit diagram of the second preferred embodiment of the present invention. The difference between the circuit configurations of the first and the second embodiment of the present invention is that, in the second embodiment, first smoothing capacitor 71 and choke coil 72 are positioned between power source 51 and bridge circuit 52.

The operation of the second embodiment of the present invention will now be described. Reference number 50 represents inverter, and control circuit 63 alternatively turns on and off first and second switching device 55, 57 as in the first embodiment of the present invention to acquire a required input power. When first switching device 55 is turned on in FIG. 1 of the first embodiment, a current is passing through heating coil 59 and at the same time a portion of the current returns to first smoothing capacitor 53 from choke coil 54. In contrast, by adopting the structure of the second embodiment, bridge circuit 52 blocks the return current, so that no current returns to first smoothing capacitor 71, and thus, an input power can be efficiently transmitted to heating coil 59 and pot 61. Since, a current with a high frequency is passing through diodes in bridge circuit 52, fast diode is preferable for the type of diode in bridge circuit 52.

As such in accordance with the second embodiment, no current returns to first smoothing capacitor 71. As a result, the input power is provided for the circuit without waste, to thereby achieve a more efficient induction heating apparatus capable of heating an aluminum pot.

(Embodiment 3)

Figure 6:
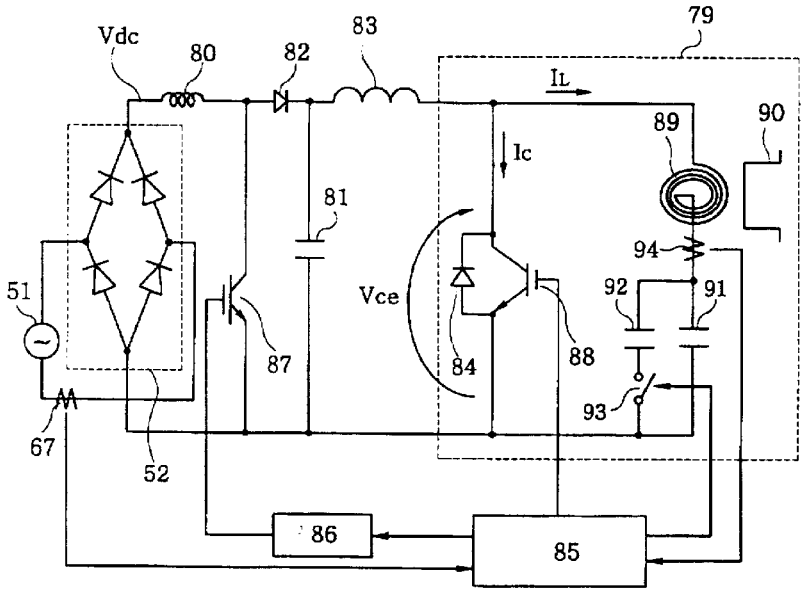
FIG. 6 presents a circuit of an induction heating apparatus in accordance with a third embodiment of the present invention.

An induction heating apparatus in accordance with a third preferred embodiment of the present invention will now be described with reference to the drawings. FIG. 6 shows a circuit configuration of the third preferred embodiment of the present invention. Power source 51 is a commercial power source and it is rectified by bridge circuit 52 and fed to collector of transistor 87 via choke coil 80. Collector of transistor 87 is connected to an anode of diode 82 and a cathode of diode 82 is connected to a first port of smoothing capacitor 81 with high electric potential. A second port of smoothing capacitor 81 with low electric potential is connected to a cathode of bridge circuit 52.

Reference number 79 indicates inverter, and one port of choke coil 83 is connected to the first port of smoothing capacitor 81 and the other port of choke coil 83 is connected to a collector of transistor 88. Series connector including heating coil 89 and resonant capacitor 91 is connected to both ports of transistor 88, and another series connector including resonant capacitor 92 and relay 93 is connected to resonant capacitor 91 in parallel. Control circuit 85 drives transistor 88 and at the same time detects a material of pot load by monitoring both detection signals from input current detector 67 for detecting input current supplied by power source 51 and resonant current detector 94 for detecting a current passing through heating coil 89. And, based on the detection result, control circuit 85 outputs a control signal or a driving signal to boosting control circuit 86, relay 93 and transistor 88. Boosting control circuit 86 outputs a driving signal to transistor 87 based on the control signal outputted by control circuit 85.

Operation of the above-mentioned structure will now be described. Control circuit 85 controls turn-on and turn-off of transistor 87 for choke coil 80 to be served as a boost chopper. Thus, an output Vdc of bridge circuit 52 is boosted and smoothed, and then it is fed to both ports of smoothing capacitor 81 via diode 82. And the boosted and smoothed voltage is served as a power source providing a high frequency current of inverter 79. Choke coil 83 is connected to the anode of bridge circuit 52 via diode 82 and choke coil 80, and it is used for a zero current switching of transistor 88 at the time transistor is turned off.

Also, diode 84 is connected to transistor 88 in inverse parallel, and is used as a current path for a resonant current returning along a reverse direction of a current flow in transistor 88. Transistor 88, when it is on, generates a resonant current, the frequency thereof being determined by heating coil 89 and resonant capacitor 91, to provide the high frequency magnetic field to load 90.

Control circuit 85 controls transistor 88 in accordance with the input power by using microcomputer etc. If control circuit 85 detects pot 90, being heated by heating coil 89, to be of a high conductivity and low permeability material, e.g., aluminum or the like, control circuit 85 drives transistor 88 as shown in FIG. 7 with relay 93 being turned off; but if control circuit 85 detects pot 90 to be of an iron-based material, control circuit 85 achieves a maximum output power by driving transistor 88 as shown in FIG. 8, while turning on relay 93 to add on capacitance to resonant capacitor 91.

Figure 7:
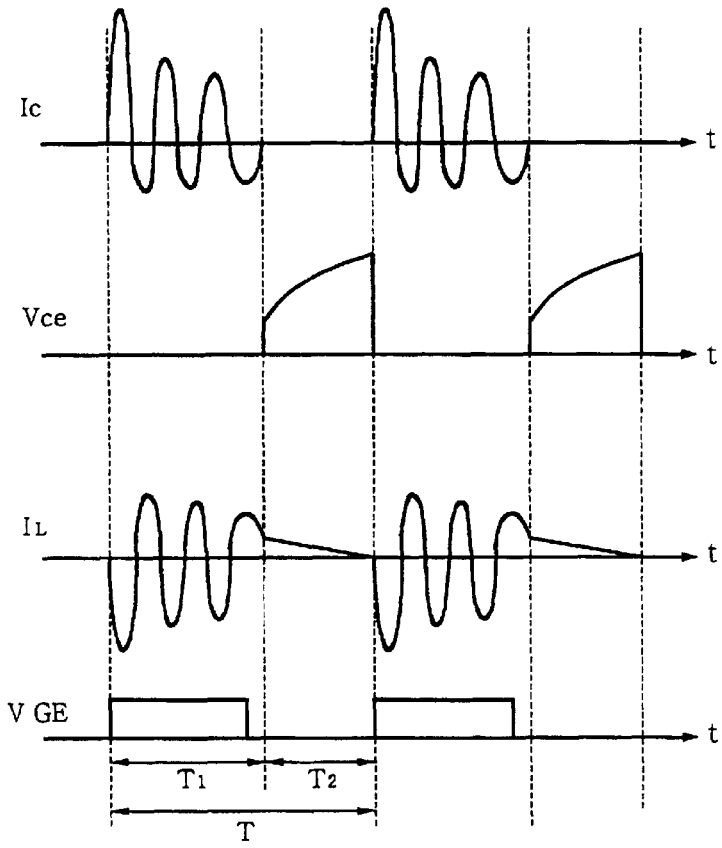
FIG. 7 depicts waveforms of a current or a voltage of each portion in the induction heating apparatus in accordance with the third embodiment of the present invention.
Figure 8:
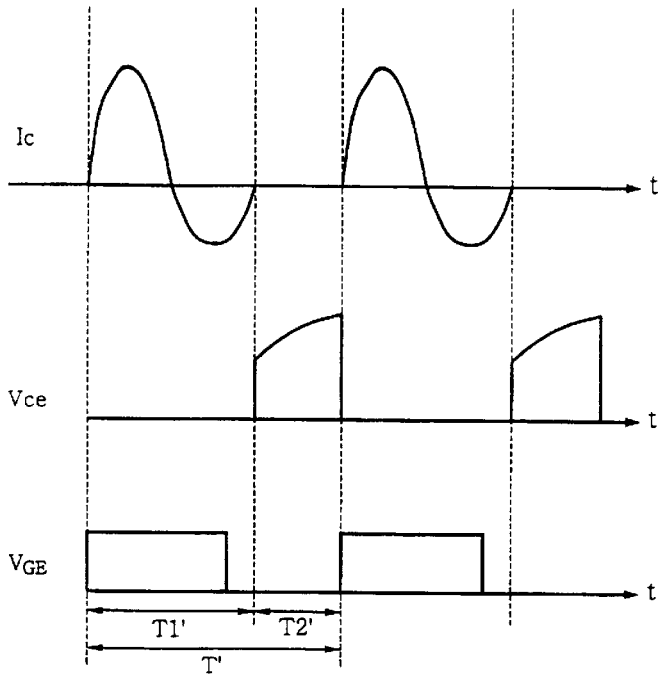
FIG. 8 represents other waveforms of a current or a voltage of each portion in the induction heating apparatus in accordance with the third embodiment of the present invention.
Figure 9:
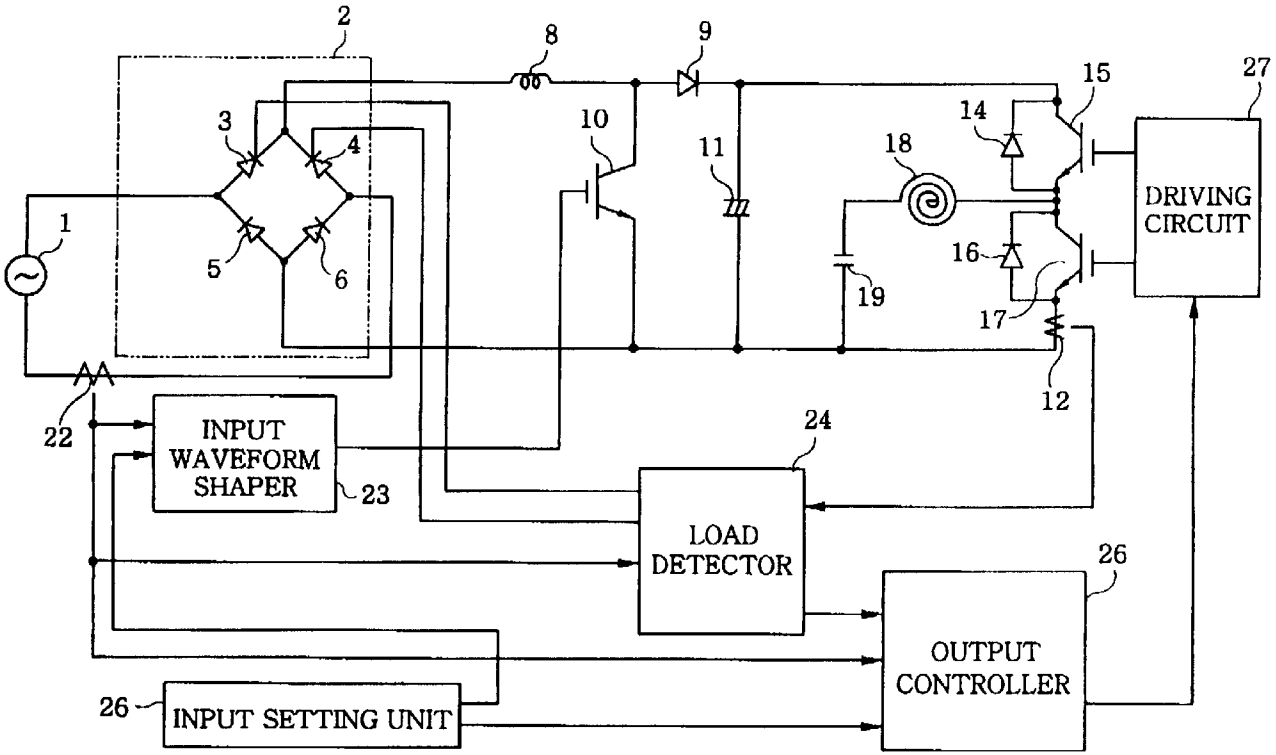
FIG. 9 (PRIOR ART)
FIG. 9 sets forth an example of a circuit of a conventional induction heating apparatus.
Figure 10:
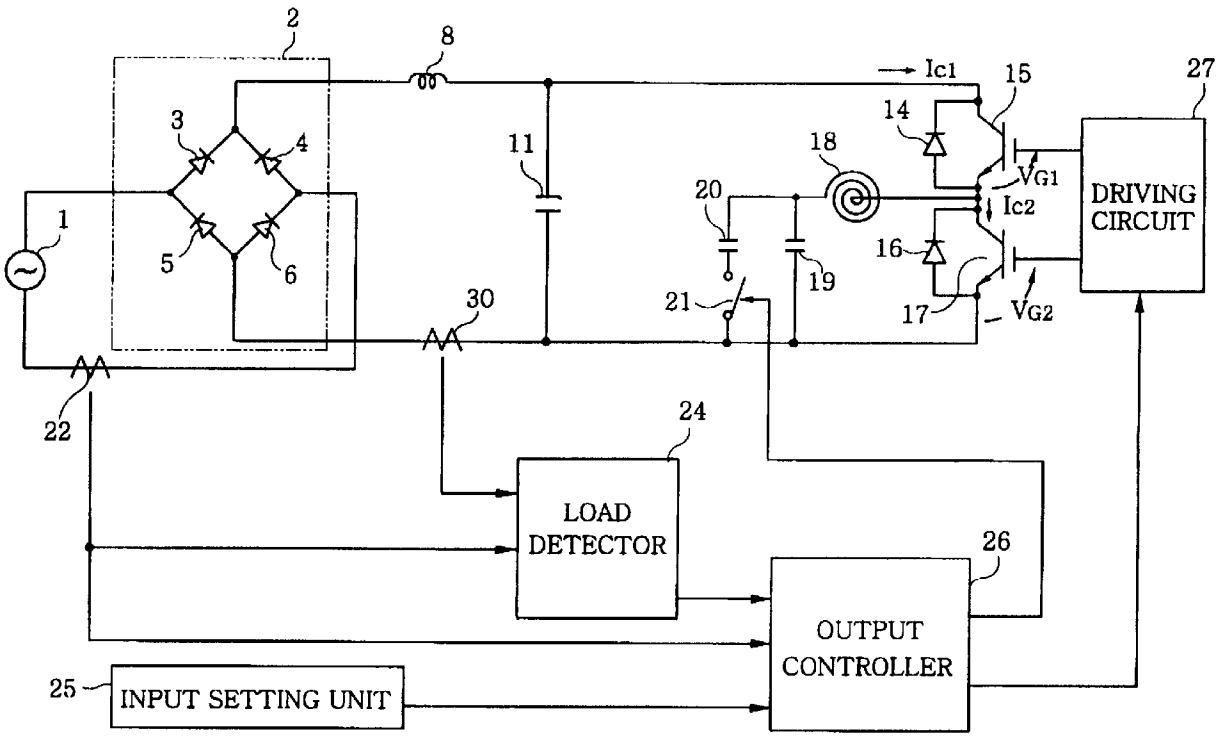
FIG. 10 (PRIOR ART)
FIG. 10 is another example of a circuit of a conventional induction heating apparatus.
Figure 11A:
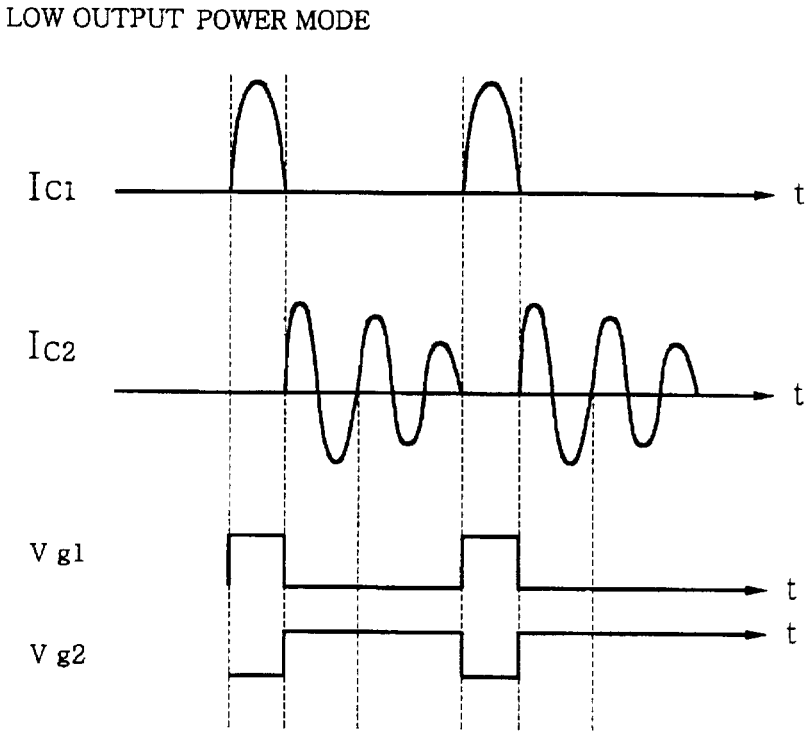
FIG. 11A (PRIOR ART)
FIG. 11 shows waveforms of a current or a voltage of each portion in the conventional induction heating apparatus of FIG. 10.
Figure 11B:
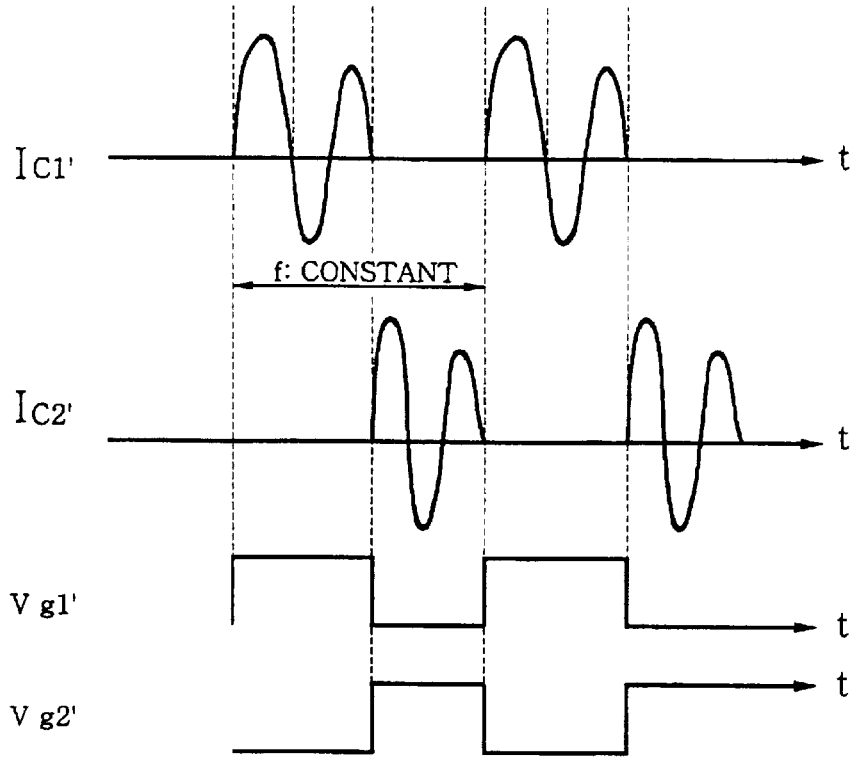
FIG. 11B (PRIOR ART)
Figure 12A:
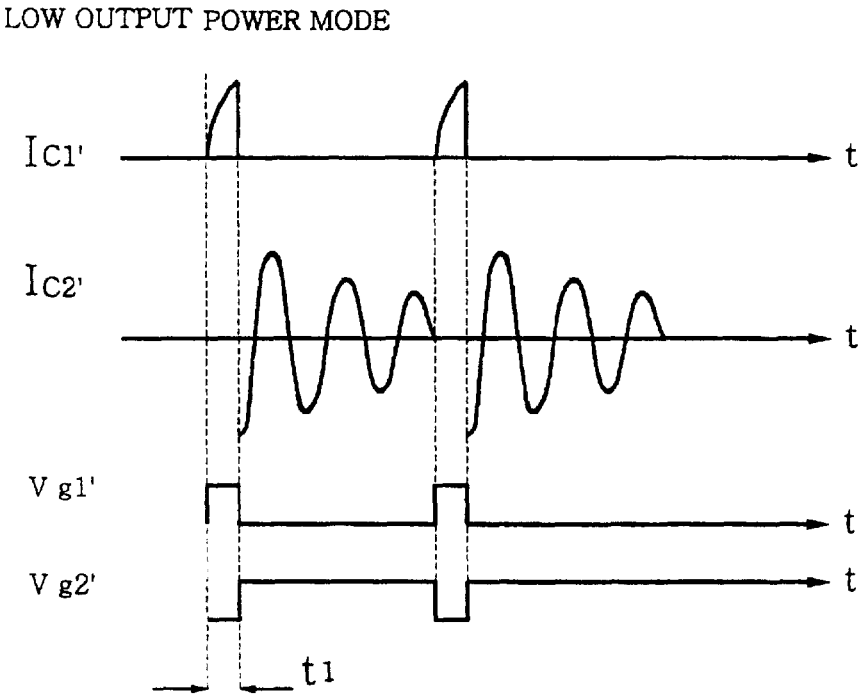
FIG. 12A (PRIOR ART)
FIG. 12 illustrates another waveforms of a current or a voltage of each portion in the conventional induction heating apparatus of FIG. 10.
Figure 12B:
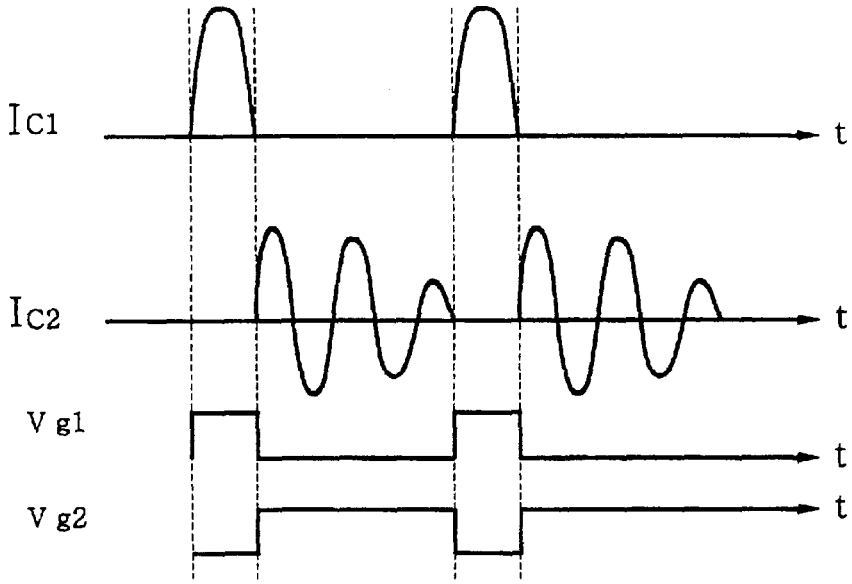
FIG. 12B (PRIOR ART)

FIG. 7 represents waveforms various portions of the circuit in accordance with the third preferred embodiment of the present invention, which includes a current Ic passing through transistor 88 and diode 84, a voltage Vce between the collector and the emitter of transistor 88, a current IL passing through heating coil 89, and a voltage Vge, which is fed to transistor 88 by control circuit 85.

Control circuit 85 transmits a driving signal to gate of transistor 88 and controls transistor 88 to be turned on. Then a resonant current, which is generated by heating coil 89 and resonant capacitor 91, is passing through transistor 88. And since a frequency of the resonant current is at least two times as high as the frequency of the driving signal, the resonant current goes to zero ultimately, and then it begins to pass through diode 84 in opposite direction; but since the resonant current continuously flows heating coil 89, a high frequency magnetic field, which is determined by the resonant frequency, is provided to pot 90. That is to say, a same effect is achieved as in the case where the driving frequency of the first embodiment is increased at least two times.

After supplying a required output power as described above, control circuit 85 turns off transistor 88 at the time a current is passing through diode 84, and after a preset time period, control circuit 85 turns on transistor 88 again, which is repeated as required.

As shown in FIG. 8, in case the material of pot 90 is iron-based, a driving period T' of transistor 88 is the sum of a pause T2' and a resonant period T1', which is determined by the inductance of heating coil 89 and the sum of the capacitances of resonant capacitor 91 and resonance compensation capacitor 92; and a driving frequency (1/T') is set at 20~30 kHz in general by considering a switching loss.

On the contrary, in case control circuit 85 detects the material of pot 90 to be aluminum etc., resonant capacitor 92 is not added to thereby raise the resonant frequency and a boosting level is controlled to increase by transistor 87 and choke coil 80.

As such, the maximum output power is achieved by reducing the pause period T2 and by maintaining an amplitude of the resonant current Ic to be above certain value throughout the required wavenumbers during the driving period T of transistor 88 as shown in FIG. 7, by way of reducing attenuation of Ic.

Herein, the resonant frequency, which is determined by the inductance of heating coil 89 coupled with pot 90 and the capacitance of resonant capacitor 91, is set to be at least two times of the driving frequency 1/T of transistor 88, i.e., a constant frequency such that at least two periods of the resonant current flows in only one switching operation. This is because skin resistance of pot is in proportion to square root of the resonant frequency in case aluminum pot, etc. are heated. In a manner described above, it becomes possible to increase the skin effect while suppressing the switching loss, enabling the heating of, an aluminum pot, a multi-layer pot, etc.

As such, if load 90 of high conductivity and low permeability is heated by the magnetic field generated at heating coil 89 in accordance with the third preferred embodiment of the present invention, the resonant current passing through switching device 88 and diode 84 resonates with the shorter period than the driving time of switching device 88. And zero current switching of the resonant current can be achieved by arranging choke coil 80 for boosting DC voltage Vdc to maintain the amplitude of the resonant current to be higher than a certain level during the driving time, switching device 87, diode 82, and smoothing capacitor 81 for smoothing the boosted voltage. In short, the driving frequency of switching device 88 is set to be lower than the resonant frequency, and zero current switching can be executed, so that aluminum pot can be heated with avoiding pot vibration noise and at the same time reducing the switching loss.

An induction heating cooking appliance in accordance with the present invention includes: bridge circuit connected to a power source in parallel; a first smoothing capacitor connected to DC output ports of the bridge circuit in parallel; a choke coil, one of the two ports thereof being connected to an anode of the DC output ports of the bridge circuit; a first semiconductor switching device, an emitter thereof being connected to the other port of the choke coil; a second semiconductor switching device, a collector thereof being connected to the other port of the choke coil and an emitter thereof being connected to the anode of the DC output ports; a first diode connected to the first semiconductor switching device in parallel; a second diode connected to the second semiconductor switching device in parallel; a series connector, including a heating coil and a resonant capacitor connected in series, connected to the second semiconductor switching device in parallel; a second smoothing capacitor connected to the emitter of the second semiconductor switching device and a collector of the first semiconductor switching device; and a controller for controlling the first and the second semiconductor switching device to achieve a certain output.

Another induction heating cooking appliance in accordance with the present invention includes: filter capacitor connected to a power source in parallel; a choke coil connected to the power source in series; a bridge circuit connected to the choke coil; a first semiconductor switching device, an emitter thereof being connected to an anode of DC output ports of the bridge circuit; a second semiconductor switching device, a collector thereof being connected to the anode of the DC output ports and an emitter thereof being connected to a cathode of the DC output ports; a first diode connected to the first semiconductor switching device in parallel; a second diode connected to the second semiconductor switching device in parallel; a series connector, including a heating coil and a resonant capacitor connected in parallel, connected to the second semiconductor switching device in parallel; a second smoothing capacitor connected to the emitter of the second semiconductor switching device and a collector of the first semiconductor switching device; and a controller for controlling the first and the second semiconductor switching device to achieve a certain output.

While the invention has been shown and described with respect to the preferred embodiments, it will be understood by those skilled in the art that various changes and modifications may be made without departing from the spirit and the scope of the invention as defined in the following claims.

What is claimed is:

1. An induction heating apparatus comprising:

an inverter having a switching device, a reverse conducting device connected to the switching device in parallel, a heating coil for heating a load by generating a magnetic field and a resonant capacitor unit, wherein the inverter generates a resonant current passing through the heating coil by turning on the switching device;

a control circuit for controlling a turn-on time of the switching device, and a boosting and smoothing circuit for boosting and smoothing an input DC voltage to provide the boosted and smoothed DC voltage to the inverter, wherein, in case the load is a material of a high conductivity and a low permeability, the resonant current passing through the switching device or the reverse conducting device resonates with a shorter period than the turn-on time of the switching device and an amplitude of the resonant current is maintained to be equal to or higher than a predetermined value during the turn-on time.

2. An induction heating apparatus comprising:

an inverter including a resonant circuit having a first series connector containing a first switching device and a second switching device connected in series, a first reverse conducting device connected to the first switching device in parallel, a second reverse conducting device connected to the second switching device in parallel, and a second series connector containing a heating coil for heating a load by generating a magnetic field and a resonant capacitor unit connected to the first or the second switching device in parallel, wherein the inverter resonates by turning on the first and the second switching device;

a control circuit for exclusively turning on the first and the second switching device; and a boosting and smoothing circuit for boosting and smoothing an input DC voltage to provide the boosted and smoothed DC voltage to the inverter, wherein, in case the load is material of a high conductivity and a low permeability, the resonant current passing through the first switching device or the first reverse conducting device resonates with a shorter period than a turn-on time of the first switching device and an amplitude of the resonant current is maintained to be equal to or higher than a predetermined value during the turn-on time.

3. The apparatus of claim 1 or 2, wherein a boosting level of the DC voltage is determined by a turn-on time of at least one switching device included in the inverter.

4. The apparatus of claim 2, wherein the boosting and smoothing circuit includes:

a smoothing capacitor connected in parallel to the first series connector including the first and the second switching device; and a choke coil connected to the second switching device in series, wherein an energy is accumulated in the choke coil when the second switching device is turned on, and then the energy is transferred to the smoothing capacitor via the first reverse conducting device by turning off the second switching device.

5. The apparatus of claim 2, wherein, in case the load is the material of the high conductivity and the low permeability, the resonant current passing through the second switching device or the second reverse conducting device resonates with a shorter period than a turn-on time of the second switching device.

6. The apparatus of claim 4, further comprising an additional smoothing capacitor for giving the energy to the choke coil when the second switching device is turned on.

7. The apparatus of claim 2, wherein, in a maximum output power mode, the control circuit outputs either a turn-off signal of the first switching device while the resonant current is passing therethrough after a start of a second period of the resonant current ensuing after turning on the first switching device, or a turn-off signal of the second switching device while the resonant current is passing therethrough after a start of the second period of the resonant current appearing after turning on the second switching device.

8. The apparatus of claim 2, wherein, in the maximum output power mode, the control circuit outputs either the turn-off signal of the first switching device during a period when the resonant current decreases from its peak value to zero after a start of the second period of the resonant current appearing after turning on the first switching device, or the turn-off signal of the second switching device during a period when the resonant current decreases from its peak value to zero after a start of the second period of the resonant current appearing after turning on the second switching device.

9. The apparatus of claim 2, wherein, in case the load is the material of the high conductivity and the low permeability, the first resonant current passing through the first switching device or the first reverse conducting device and the second resonant current passing through the second switching device or the second reverse conducting device resonate with periods being approximately ⅔ of the turn-on times of the first or the second switching device, respectively.

10. The apparatus of claim 2, wherein, the ratio of the turn-on times of the first and the second switching device is set at about 1, and if the load is the material of the high conductivity and the low permeability, the resonant current passing through the first switching device or the first inverse-parallel diode resonates with the period being approximately ⅔ of the turn-on time of the first switching device.

11. The apparatus of claim 2, wherein, in starting a heating operation, an output power of the apparatus is increased by varying the ratio of turn-on times of the first and the second switching device and then by varying a driving frequency of the first and the second switching device.

12. The apparatus of claim 11, wherein upon initiating the heating operation, the turn-on time of the first switching device is set to be shorter than the resonant period of the resonant current and then the output power is increased by changing the ratio of turn-on times of the first and the second switching device; and after a predetermined turn-on time or a predetermined ratio of turn-on times is reached, the turn-on time of the first switching device is increased to lower the output power, and then the output power is increased from a low level to a desired level by gradually increasing the turn-on time.

13. The apparatus of claim 2, wherein, in case the load is an iron-based material or a non-magnetic stainless steel, the resonant current resonates with a longer period than the turn-on time of the first or the second switching device; and in case of heating the load of the iron-based material or the non-magnetic stainless steel with a maximum output power, a capacitance of the resonant capacitor unit is increased to be greater than that in a case when the load is of the high conductivity and the low permeability, in order to turn off the first and the second switching device at a time when a current passes through each of the first and the second switching device in a forward direction.

14. The apparatus of claim 13, wherein, when starting the heating operation, the resonant capacitor unit is set to have a first capacitance and the output power of the apparatus is controlled to increase gradually; and while increasing the output power it is checked whether the load is the iron-based material or the material of the high conductivity and the low permeability, and if the load is found to be the iron-based material, the heating operation is stopped and the resonant capacitor unit is converted to have a second capacitance, the second capacitance being greater than the first capacitance, and then the heating operation is resumed with a decreased driving frequency; but if load is detected to be the material of the high conductivity and the low permeability, the output power continues to increase until a predetermined ratio of turn-on times or a predetermined output power is reached, and then the ratio of turn-on times is maintained to have a substantially constant value and the turn-on times of the switching devices are varied, until reaching a target output power.

* * * * *